United States Patent [19]

Wiand

[11] Patent Number: 4,968,326

[45] Date of Patent: Nov. 6, 1990

[54] METHOD OF BRAZING OF DIAMOND TO SUBSTRATE

[76] Inventor: Ronald C. Wiand, 1494 Heatherwood Run, Troy, Mich. 48098

[21] Appl. No.: 418,841

[22] Filed: Oct. 10, 1989

[51] Int. Cl.[5] ..... B24D 3/00

[52] U.S. Cl. ..... 51/293; 51/295; 51/298; 51/309

[58] Field of Search ..... 51/293, 295, 298, 309

[56] References Cited

U.S. PATENT DOCUMENTS

| | | | |
|---|---|---|---|
| 3,192,620 | 7/1965 | Huizing et al. | 29/473.1 |
| 3,372,010 | 3/1968 | Prasons | 51/309 |
| 4,009,027 | 2/1977 | Naidich et al. | 75/154 |
| 4,018,576 | 4/1977 | Lowder et al. | 51/309 |
| 4,527,998 | 7/1985 | Kremeyer | 51/309 |
| 4,610,699 | 9/1986 | Yazu et al. | 51/293 |
| 4,682,987 | 7/1987 | Brady et al. | 51/293 |
| 4,776,862 | 10/1988 | Wiand | 51/293 |

FOREIGN PATENT DOCUMENTS 837321 3/1970 Canada .

*Primary Examiner*—William R. Dixon, Jr.
*Assistant Examiner*—Willie Thompson
*Attorney, Agent, or Firm*—Harness, Dickey & Pierce

[57] ABSTRACT

A method of making a diamond cutting and abrading tool. The method includes the following steps:

(A) Mixing molybdenum with a braze which alloys with the carbide forming substance and a temporary binder to provide a coating material;

(B) Applying said coating material to a tool substrate;

(C) Applying at least a monolayer of diamond particles thereover; and (D) Heating the product of step (C) at a temperature sufficient to initially form a metal carbide coating on the diamond and thereafter to braze the carbide coated diamond to the tool substrate.

10 Claims, 1 Drawing Sheet

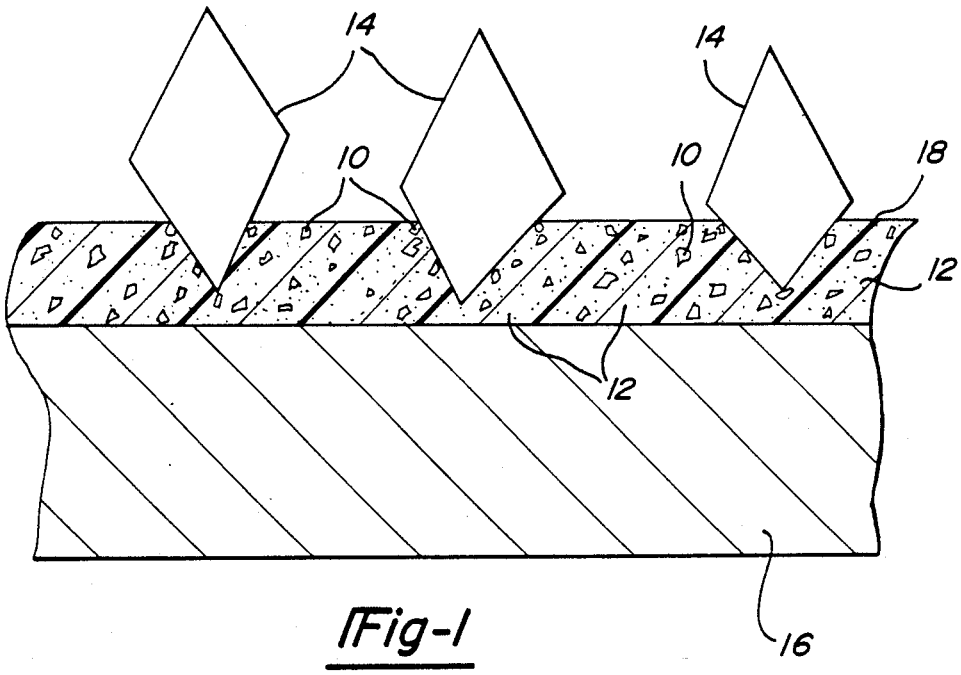
Fig-1
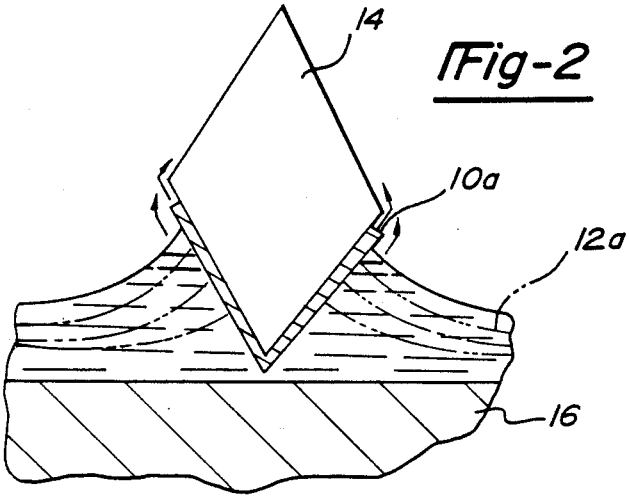
Fig-2
Fig-3
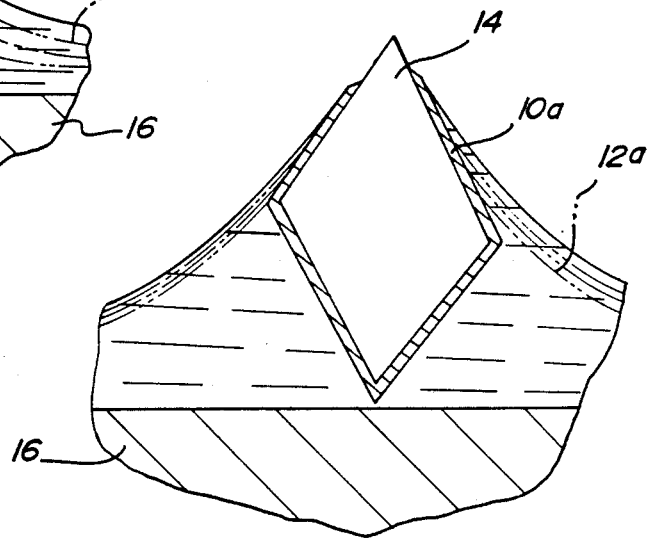

METHOD OF BRAZING OF DIAMOND TO SUBSTRATE

BACKGROUND AND SUMMARY OF THE INVENTION

The present invention relates to diamond tools. More particularly, the present invention relates to a method of brazing diamond abrasive particles to a substrate to make a monolayer diamond abrasive or cutting tool. The present invention facilitates control of the strength with which abrasive particles are held by the bonding agent.

There are various methods of making diamond abrasive or cutting tools. The present invention is concerned with monolayer diamond abrasive tools which are tools having only a single layer of diamond abrasive particles on the tool substrate. Monolayer diamond abrasive tools encounter difficulties in regard to attaching the individual diamond abrasive particles to the tool substrate or core. This is especially the case where a brazing or soldering technique is employed.

A variety of bonding methods have heretofore been used for bonding diamond or other carbon containing abrasives by brazing or soldering. At the present time, known brazing alloys for diamond abrasive materials include alloys based on copper, silver or gold doped with additives of iron, cobalt and nickel taken either separately or in combination with one another.

Also known are brazing alloys such as, copper-titanium, silver titanium, gold titanium, tin titanium, lead-titanium, copper-molybdenum, copper zirconium, copper vanadium, gold-tantalum, gold-niobium, copper-silver-titanium, copper-gold titanium, bronze-titanium and copper-tin-titanium. The content of Ti, Mo, Zr and V in such alloys generally amounts up to 10 weight percent, see for examples, "Wetting and Interaction of Metal Melts with Surface of Diamond and Graphite", Yu. V. Naidich and G. A. Kolesuichenko, "Naukova dumku" Publishers, Kiev 1967 (in Russian).

Another brazing alloy known for use with diamond is essentially an alloy of gold with 1–25 weight percent of tantalum, U.S. Pat. No. 3;192,620. This alloy, however, has a high liquid-phase point (above 1050° C.) and therefore is restricted but to a narrow field of application, since at 1050° C. and over diamond is liable to vigorously pass into a hexagonal form of carbon which adversely affects the strength of the abrasive.

Another diamond brazing alloy now in common use, consists of 75 weight percent copper and 25 weight percent of titanium.

A disadvantage of this alloy is that it is brittle and its thermal expansion factor differs substantially from that of the diamond. These properties lead to thermal stresses in finished products which, in turn, lead to rapid failure in the course of operation and consequently, high and premature wear of the tool made of such abrasives.

All of the brazing alloys described above are used also for metallization of abrasives made of diamond, cubic boron nitride, corundum, etc. Apart from the alloys discussed above, there are also known some alloys and single metals for surface metallization of abrasive, Viz., diamond, cubic boron nitride, silicon carbide, and tungsten carbide, the metallization being either single or multiple-layer. For establishing the initial layer, use is made of nickel, copper, zinc, tin, gold, lead or their alloys; if a second layer is desired, iron-nickel alloy is used or the like. For the third layer, copper or bronze is commonly used.

The coated crystals are then used to make polycrystalline diamond compacts as are commonly used in sintered metal bonded abrasive and cutting tools.

It is known in the art to metallize diamond and abrasives using alloys of silver-gold-titanium-cobalt-tantalum, copper-tin-tungsten and/or molybdenum-tantalum-nickel and/or cobalt-lead and/or bismuth-titanium and/or zirconium. Alloys used for brazing feature the use of an alloy of copper-tin-tungsten, molybdenum-tantalum-titanium and/or zirconium-cobalt and/or nickel-lead and/or bismuth, see for example, U.S. Pat. No. 4,009,027).

Yet another known brazing alloy contains nickel and/or cobalt-chromium-boron and/or silicon and/or phosphorous, see for example, U.S. Pat. No. 4,018,576). Chromium is claimed to wet the surface of the diamond causing tenacious adhesion of the diamond to the braze.

One common disadvantage of the above methods is that they are limited in the scope of their ability to vary the strength with which the braze bonds to the diamond. Another disadvantage of some methods is their use of costly precious metals and vacuums of $10^{-5}$ torr. Even the use of metals such as copper is not economical as they cannot be processed without the use of a high vacuum or expensive dry hydrogen furnaces so as not to form hydrides of the active metals.

Furthermore, most processes in the art heretofore required that two separate costly operations be performed; first coating the abrasive by metallizing or the like and then applying a braze in an additional operation.

There remains a need, however, for an improved low cost practical method of brazing a monolayer of diamond particles to a tool substrate. In accordance with the present invention, an improved method of forming a brazed monolayer of diamond particles is provided which is simpler and more effective than these prior methods. In the present invention, a carbide forming substance including a carbide forming element is mixed with a braze material in a temporary binder. This coating is coated onto the tool substance and a layer of diamonds is applied thereover. The resultant tool is heated to an effective temperature for allowing the carbide forming substance to form an initial element carbide layer on the surface of the diamond after which the braze may readily attach to the carbide layer to securely hold the diamond to the tool substrate. The method of the present invention also has the advantage that the carbide and braze layers tend to climb up the side of the diamond particle as the heating step progresses, thereby allowing for increased strength in the final brazed tool. Additionally, the bond strength can be varied by varying the amount of carbide forming material used in the initial mixture utilized and the processing time which controls the climb of the carbide formation in the present invention.

Additional benefits and advantages of the present invention will become apparent from the subsequent description and the appended claims taken in conjunction with the accompanying drawings.

BRIEF DESCRIPTION OF THE DRAWINGS

FIG. 1 is a cross-sectional view showing the "green" state of a tool prepared in accordance with the teachings of the present invention;

FIG. 2 is a sectional view illustrating the progression of the method during the heating step; and FIG. 3 is a sectional view of a diamond particle after completion of the heating step.

DESCRIPTION OF THE INVENTION

Generally speaking, the present invention involves the steps of: (A) Mixing a carbide forming substance containing an element capable of forming a carbide, a braze which alloys with the carbide forming substance and a temporary binder to provide a coating material;

(B) Applying said coating material to a substrate;

(C) Applying at least a monolayer of diamond particles thereover; and (D) Heating the product of step (C) at a temperature sufficient to initially form a an element carbide coating on the diamond and thereafter to braze the carbide coated diamond to the substrate.

Referring to the drawings, in accordance with the first step of the present invention, a mixture of a carbide forming substance 10, a brazing material 12 and a temporary binder 18 is prepared and thereafter applied to a tool substrate 16.

The carbide forming substance preferably includes a metal which will form a metal carbide layer on the diamond particles during the heating step. Suitable carbide forming metals are well known in the art and include, for example, iron, molybdenum, chromium, tantalum, titanium, zirconium, tungsten, niobium, vanadium, maganese, germanium and silicon, and mixtures thereof. It will be appreciated that such carbide forming metals can be used in the form of their carbide forming compounds such as molybdenum silicide or tungsten carbide, the free metal of which can form carbides. Iron and molybdenum are preferred metals and may be used singly or in combination. In the preferred embodiment from about 2 to about 30% of the carbide forming substance is mixed with 20% to 80% braze.

The temporary binder selected must be temporary in that it is easily driven off in the heating step but allows temporary suspension of the carbide forming substance component and the brazing material component of the coating. It is preferable that the binder is somewhat viscous such that the above components may be easily suspended. It is also preferable that the binder utilized will be somewhat tacky such that the diamond particles are retained on the tool surface coated with the above mixture. A preferred binder is a urethane based adhesive, such as a Wall Colmonoy "S" type binder. Other suitable binders include acrylic resins, methylmethacrylate resins, lacquers paints and the like. The binder used also must be relatively inert in that it must not adversely affect the components in the final heating step.

The braze material selected is chosen to be compatible with the particular carbide forming metal utilized in the carbide forming substance, i.e. to alloy with the carbide forming metal. Suitable brazes include nickel, silver, gold or copper based brazes. Suitable brazes are commercially available, for example, from Wall Colmonoy Corporation of Detroit, Mich. under the Nicrobraz® line.

In accordance with the second step of the present invention, the mixture of carbide forming substance, braze material and binder is coated onto the desired surface of tool substrate 16 in a somewhat uniform layer. This may be accomplished by brushing, spraying or dipping of the surface of the tool 16 in the mixture. While this layer is still tacky, a monolayer of diamond particles 14 is applied to the tacky layer. The diamond particles 14 may be applied either singly by hand application or could be applied by sprinkling of diamond particles onto the tool.

According to the fourth step of the present invention, the "green" tool, as shown in FIG. 1, with the layer of the coating mixture and diamond material is heated at an effective temperature to allow formation of an initial metal carbide layer **10*a*** which is chemically bonded to the diamond surface. This ensures that the braze has a compatible metal carbide surface coating on which to attach to the diamond. In the preferred embodiment the heating step is accomplished in a vacuum of about $10^{-4}$ torr. However, the method of the present invention may be practiced in hydrogen containing atmospheres or in substantially reducing atmospheres with good results.

While not wishing to be bound by any particular theory, it is believed that initially the diamond is in contact with at least some of the metal carbide forming particles or comes into contact with carbide forming metals during flow of the molten braze solution which includes the carbide forming metals in the molton solution. Upon heating to an effective temperature, a metal carbide layer **10*a* begins to form on the diamond from the carbide forming metal immediately adjacent the graphitized diamond surface. Thereafter, the molten braze 12*a*** has an appropriate place to attach to the diamond.

The reaction taking place in the present invention proceeds in a quasi-capillary manner up along the side of the diamond to allow the final braze material to progress up the diamond surface to a desired level or even to entirely cover the diamond with a braze layer if desired. It is believed that this phenomenon occurs by the initial formation of the carbide layer after which the braze attaches allowing more of the carbide forming substance to come into contact and chemically bond to the diamond surface forming another suitable location for brazing to attach. In this manner the brazing metal is drawn up the side of the diamond particles in a quasi-capillary manner to the desired level. The height of the braze layer may be controlled by varying the time of the heating step.

Thus, during the heating step, the diamond can be heated to a temperature sufficient to cause free carbon atoms at the diamond surface and to form the desired metal carbide coating from the localized carbide forming metal. Formations of the metal carbide facilitates wetting of the diamond surface by the braze metal. The time and temperature of the heating step is determined by the particular carbide forming metal and braze composition chosen for use. Upper limits are determined by excessive graphitization or even complete breaking down of the diamond. Lower limits are functionally determined in that sufficient heating must be maintained to form the metal carbides and to melt the braze composition. Additionally, time and temperature may be utilized to control the amount of coverage of the diamond surface by the braze and the amount of filleting which is desired about the diamond particles.

As stated above, the braze is selected to be compatible, i.e. to alloy with the metal carbide on the diamond surface. Thus, good wetting of the diamond carbide interface is achieved and a strong braze bond is obtained.

Further understanding of the present invention will be had from the following examples:

EXAMPLE I

For the brazing of a peripheral diamond grinding wheel, a steel core of 6.00" diameter and 0.625" thick was used. The 0.625" surface was coated by brushing on a paste consisting of Wall Colmonoy "S" cement and a mixture of Wall Colmonoy Nicrobraze® #10 Fe and Mo in the following weight percents:

| | |
|---|---|
| Nicrobraze #10 (P = 10%, C = .06% BAL. = NI) | 86% |
| Fe(−325 Mesh, Hydrogen Reduced) | 3.2% |
| Mo(6–12 Micron) | 10.8% |

While the paste was still wet, 80/100 mesh diamond was sprinkled onto the paste. The coated core was allowed to air dry. The coated core was placed in a vacuum furnace that was computer controlled to carefully control the heat up and cool down cycle. The core and diamond mixture was heated to 1745° F. at $10^{-4}$ torr and heated for 45 seconds. The results were a diamond wheel suitable for bevel edging CR-39 plastic ophthalmic lenses. The diamonds were found to be tenaciously held in the braze with about twenty five percent of the diamond exposed.

EXAMPLE II

For the brazing of a cup type wheel used to generate the optical curvature in an ophthalmic lens, a 3½" diameter with a 0.125" radius face steel core was coated with a paste of Wall Colmonoy "S" cement and a mixture of Wall Colmonoy Nicrobraze® #10 with Fe and Mo in the weight percents as follows:

| | |
|---|---|
| Nicrobraze® #10 | 80% |
| Fe (Same as in Example I) | 10% |
| MO (Same as in Example I) | 10% |

40/45 mesh diamond was sprinkled onto the wheel core as in Example I and processed as in Example I except the heating step used was 1730° F. at $10^{-4}$ for 45 seconds. The resultant tool was successfully used for grinding CR-39 ophthalmic lenses. The diamonds were found to be tenaciously held in the braze with about twenty five percent of the diamond surface exposed.

EXAMPLE III

A router bit core made of steel was coated as in Example I with the following braze mixture constituent:

| | |
|---|---|
| Nicrobraze #130 (B = 3.1%, Si = 4.5% C = .06% BAL. −Ni) | 80% |
| Fe (Same as in Example I) | 10% |
| Mo (Same as in Example I) | 10% |

The coated router bit was furnaced at a temperature of 1900° F. at $10^{-4}$ torr for 12 seconds.

The resultant tool was very successful in the grinding of marble. The diamonds were tenaciously held in the braze (but to a lesser extent than in Examples I and II) with about seventy five percent exposure of the diamond surface.

What is claimed is:

1. A method of making a diamond cutting and abrading tool comprising the steps of:
   (A) Mixing a carbide forming substance containing an element capable of forming a carbide, a braze which alloys with the element and a temporary binder to provide a coating material;
   (B) Applying said coating material to a tool substrate;
   (C) Applying at least a monolayer of diamond particles thereover; and
   (D) Heating the product of step (C) at a temperature sufficient to initially form an element carbide coating on the diamond and thereafter to braze the element carbide coated diamond to the tool substrate.

2. The method of claim 1 wherein said carbide forming element is a carbide forming metal.

3. The method of claim 2 wherein said carbide forming metal is a powder.

4. The method of claim 1 wherein said carbide forming substance is selected from the group consisting of iron molybdenum, chromium, titanium, tantalum, zirconium, tungsten, niobium, vanadium, germanium, silicon, molybdenum, silicides or carbides of these elements or mixtures thereof.

5. The method of claim 1 wherein said carbide forming substance is iron.

6. The method of claim 1 wherein said carbide forming substance is molybdenum.

7. The method of claim 1 wherein said carbide forming substance is a mixture of iron and molybdenum.

8. A method of making a diamond cutting and abrading tool comprising the steps of:
   (A) Mixing a carbide forming substance comprising molybdenum and iron with a braze which alloys with the molybdenum and iron and a temporary binder to provide a coating material;
   (B) Applying said coating material to a tool substrate;
   (C) Applying at least a monolayer of diamond particles thereover; and
   (D) Heating the product of step (C) at a temperature sufficient to initially form a carbide coating on the diamond and thereafter to braze the carbide coated diamond to the tool substrate.

9. A method of making a diamond cutting and abrading tool comprising the steps of:
   (A) Mixing an iron with a braze which alloys with iron and a temporary binder to provide a coating material;
   (B) Applying said coating material to a tool substrate;
   (C) Applying at least a monolayer of diamond particles thereover; and
   (D) Heating the product of step (C) at a temperature sufficient to initially form a carbide coating on the diamond and thereafter to braze the carbide coated diamond to the tool substrate.

10. A method of making a diamond cutting and abrading tool comprising the steps of:
   (A) Mixing molybdenum with a braze which alloys with the molybdenum and a temporary binder to provide a coating material;
   (B) Applying said coating material to a tool substrate;
   (C) Applying at least a monolayer of diamond particles thereover; and
   (D) Heating the product of step (C) at a temperature sufficient to initially form a molybdenum carbide coating on the diamond and thereafter to braze the molybdenum carbide coated diamond to the tool substrate.

* * * * *